US005310063A

United States Patent [19]

Skolasinski

[11] Patent Number: 5,310,063

[45] Date of Patent: May 10, 1994

[54] PALLET DISPLAY APPARATUS

[76] Inventor: Lauraine K. Skolasinski, 4214 Columbine Way, #5, Vail, Colo. 81657

[21] Appl. No.: 99,472

[22] Filed: Jul. 30, 1993

[51] Int. Cl.[5] ..... B65D 19/00

[52] U.S. Cl. ..... 206/600; 206/386; 206/804; 220/4.28

[58] Field of Search ..... 206/386, 556, 600, 804; 220/1.5, 4.28, 4.31

[56] References Cited

U.S. PATENT DOCUMENTS

| | | | |
|---|---|---|---|
| 2,056,279 | 10/1936 | Kulick | 206/804 |
| 3,266,656 | 8/1966 | Kridle | 220/4.28 |
| 3,371,816 | 3/1968 | Ricci | 220/4.28 |
| 3,828,964 | 8/1974 | Bonnot | 206/600 |
| 3,953,090 | 4/1976 | Fuchs | 206/556 |
| 4,050,604 | 9/1977 | Flanders | 220/4.28 |
| 4,609,116 | 9/1986 | Simms | 220/4.28 |
| 4,673,087 | 6/1987 | Webb | 206/600 |
| 4,782,972 | 11/1988 | Wenkman et al. | 220/4.28 |
| 4,785,957 | 11/1988 | Beck et al. | 220/4.28 |
| 4,789,075 | 12/1988 | Sun | 206/804 |
| 4,809,851 | 3/1989 | Oestreich, Jr. et al. | 220/4.31 |
| 4,831,681 | 5/1989 | Puder | 206/77.1 |

FOREIGN PATENT DOCUMENTS

| | | | |
|---|---|---|---|
| 611899 | 10/1960 | Italy | 220/4.31 |
| 2245883 | 1/1992 | United Kingdom | 206/600 |

*Primary Examiner*—David T. Fidei
*Attorney, Agent, or Firm*—Leon Gilden

[57] ABSTRACT

A platform base having an apertured top wall includes a side wall having a continuous groove therewithin, wherein the continuous groove is arranged to receive panel members to enclose and surround the base top wall, with the panel members including inter-engaging flange and slot structures to secure the panel members in a fixed assembly relative to one another. The panel members are further provided with panel member top walls arranged to accommodate further panel members to permit a stacking of the panel members as desired. A modified base structure includes top walls having facing top wall slots to receive a U-shaped latch member to secure a plurality of such base members together.

2 Claims, 5 Drawing Sheets

FIG 3
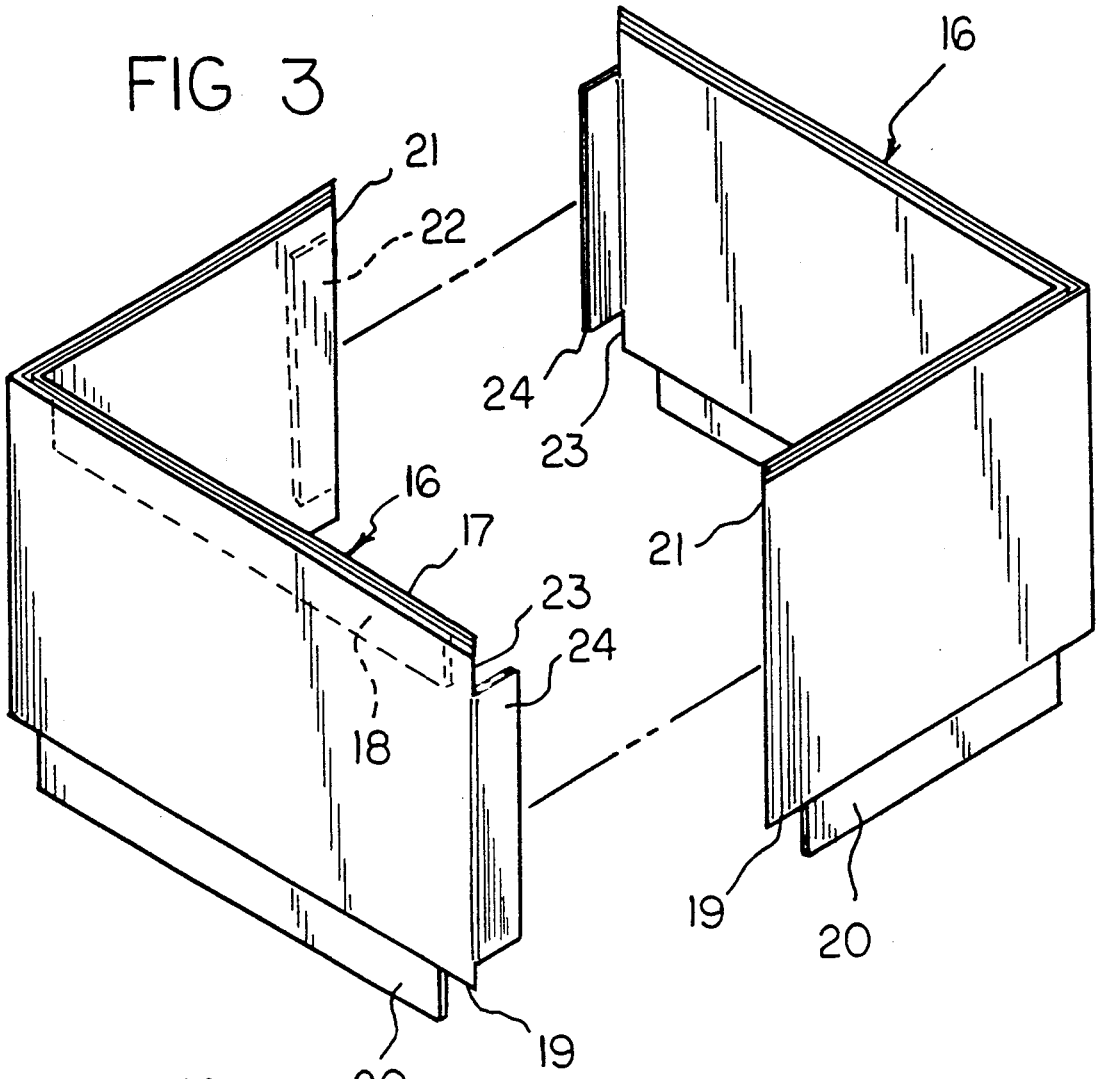
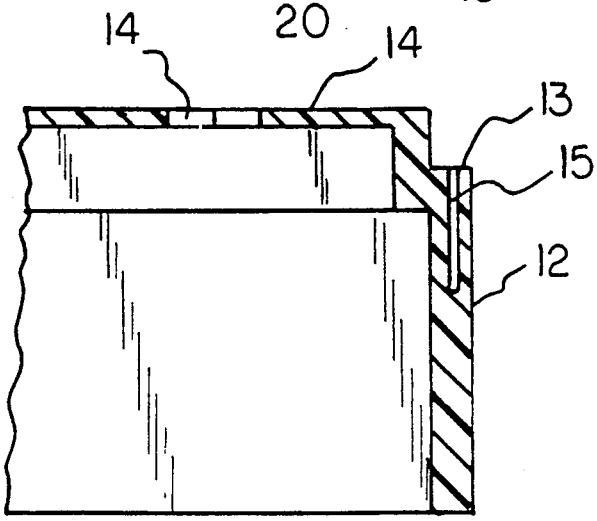
FIG 4

FIG 6
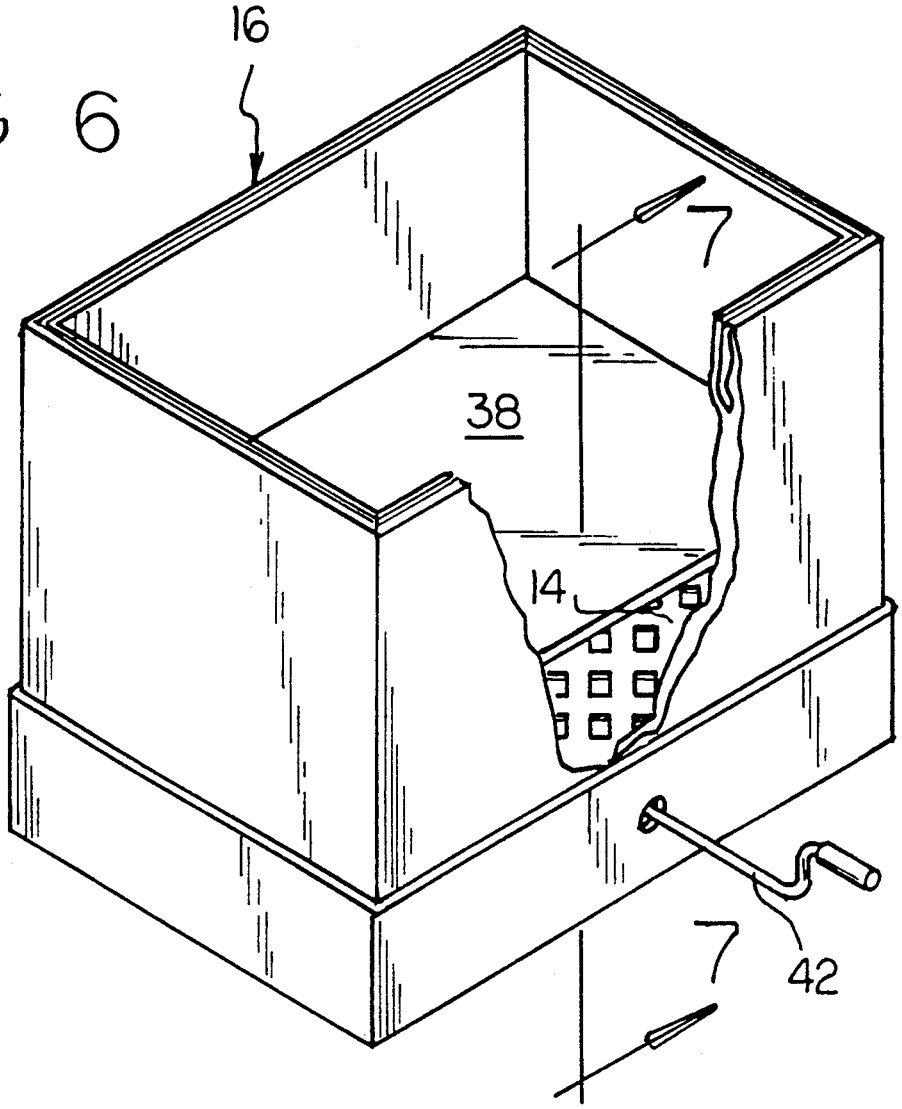
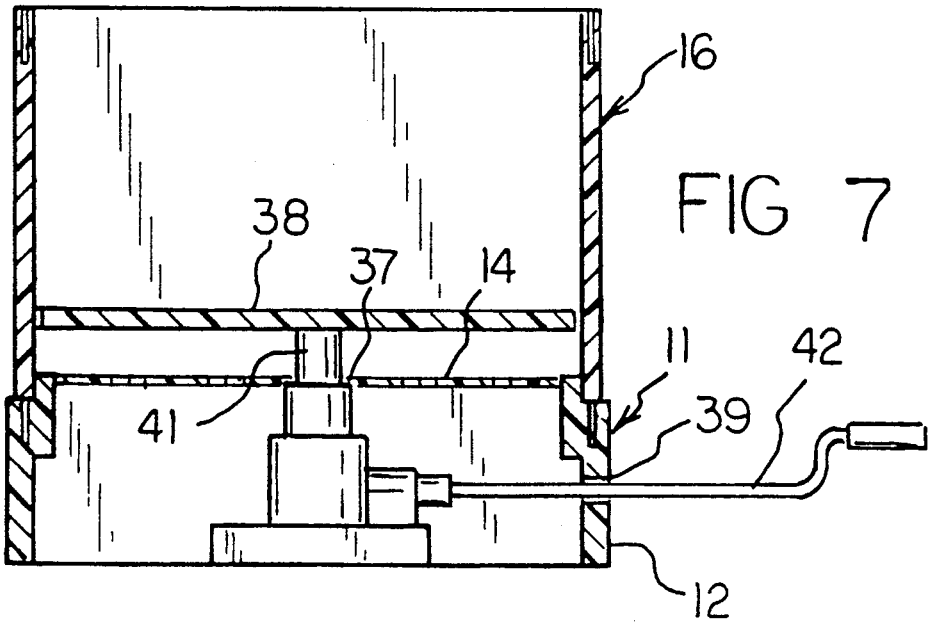
FIG 7

PALLET DISPLAY APPARATUS

BACKGROUND OF THE INVENTION

1. Field of the Invention

The field of invention relates to display structure, and more particularly pertains to a new and improved pallet display apparatus wherein the same is arranged for ease of assembly to receive and permit display of various merchandise.

2. Description of the Prior Art

In various sales such as retail sales, display of various products is provided for visual impact to enhance the sales of such merchandise. To this end, the instant invention provides for a pallet display provided with base and pallet members readily erected for use in a display environment. Prior art pallet structure as indicated is to be provided with support bases individually, wherein such prior art pallets have typically utilized a wrapping structure to receive and secure a merchandise component to permit ease of transport and shipping of such components. Prior art structure to this end is indicated in U.S. Pat. Nos. 5,035,323 and 4,919,270.

SUMMARY OF THE INVENTION

In view of the foregoing disadvantages inherent in the known types of pallet apparatus now present in the prior art, the present invention provides a pallet display apparatus wherein the same employs a plurality of components to permit the positioning and individual display of merchandise for sale purpose. As such, the general purpose of the present invention, which will be described subsequently in greater detail, is to provide a new and improved pallet display apparatus which has all the advantages of the prior art pallet apparatus and none of the disadvantages.

To attain this, the present invention provides a platform base having an apertured top wall, including a side wall having a continuous groove therewithin, wherein the continuous groove is arranged to receive panel members to enclose and surround the base top wall, with the panel members including inter-engaging flange and slot structures to secure the panel members in a fixed assembly relative to one another. The panel members are further provided with panel member top walls arranged to accommodate further panel members to permit a stacking of the panel members as desired. A modified base structure includes top walls having facing top wall slots to receive a U-shaped latch member to secure a plurality of such base members together.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pallet display apparatus which has all the advantages of the prior art pallet apparatus and none of the disadvantages.

It is another object of the present invention to provide a new and improved pallet display apparatus which may be easily and efficiently manufactured and marketed.

It is a further object of the present invention to provide a new and improved pallet display apparatus which is of a durable and reliable construction.

An even further object of the present invention is to provide a new and improved pallet display apparatus which is susceptible of a low cost of manufacture with regard to both materials and labor, and which accordingly is then susceptible of low prices of sale to the consuming public, thereby making such pallet display apparatus economically available to the buying public.

Still yet another object of the present invention is to provide a new and improved pallet display apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the enclosure members for use by the invention.

FIG. 4 is an orthographic view, taken along the lines 4—4 of FIG. 2 in the direction indicated by the arrows.

FIG. 6 is an isometric illustration of the invention to further include a displaceable floor member.

FIG. 7 is an orthographic view, taken along the lines 7—7 of FIG. 6 in the direction indicated by the arrows.

DESCRIPTION OF THE PREFERRED EMBODIMENT

Figure 1:
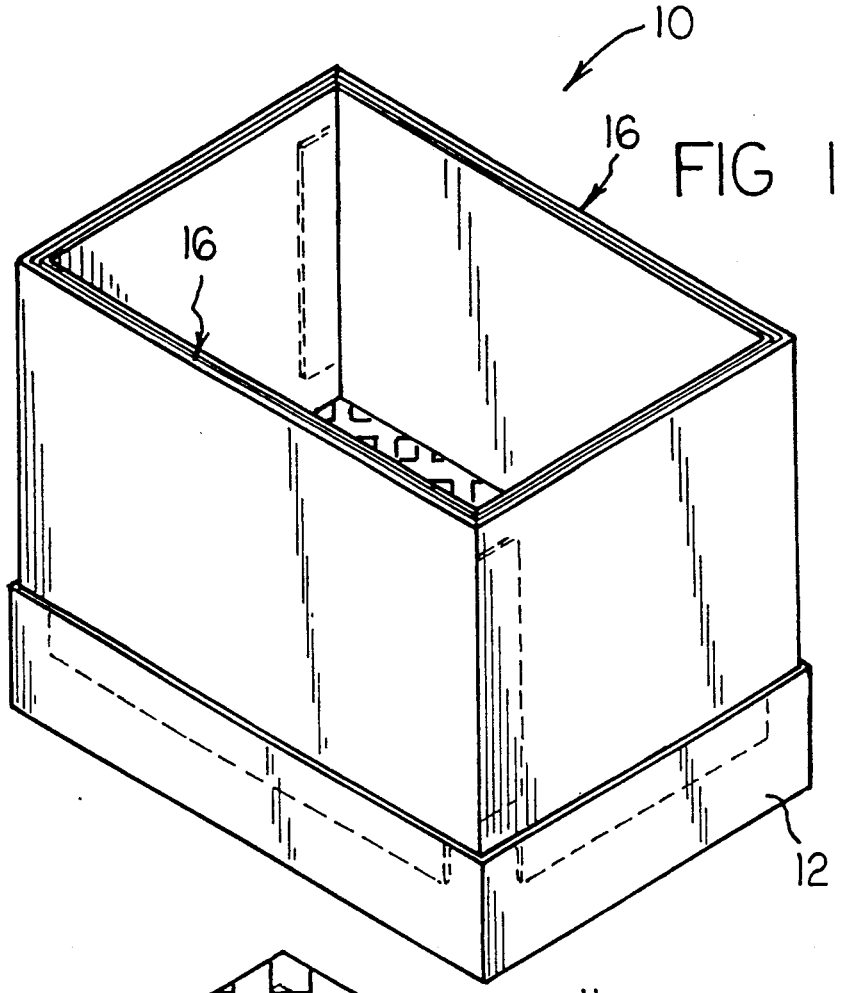
FIG. 1 is an isometric illustration of the invention.
Figure 2:
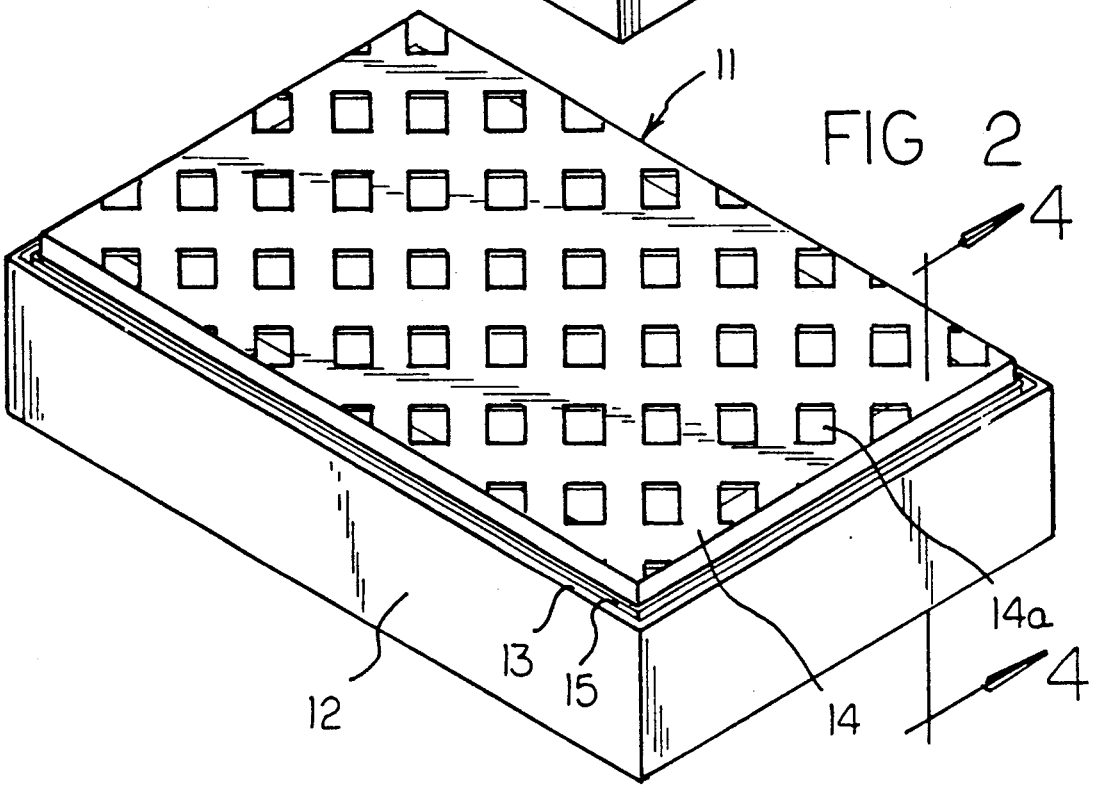
FIG. 2 is an isometric illustration of the base structure of the invention.

With reference now to the drawings, and in particular to FIGS. 1 to 9 thereof, a new and improved pallet display apparatus embodying the principles and concepts of the present invention and generally designated by the reference numeral 10 will be described.

More specifically, the pallet display apparatus 10 of the instant invention essentially comprises a platform base 11, having a continuous side wall 12, with the side wall 12 having a side wall top surface 13 spaced from a base top wall 14 having a matrix of drain openings 14*a* directed therethrough. The side wall top surface 13 is positioned below the base top wall 14 between the base top wall and a lowermost end of the side wall 12, wherein the base top wall 14 is provided with a continuous top wall groove 15 to permit reception of a plurality of L-shaped enclosure panel members 16, in a manner as indicated in FIG. 1. Each of the enclosure panel members 16 includes a panel top wall 17 having a panel top wall groove 18, a panel bottom wall 19 having a panel bottom wall engaging flange 20 for registration and securement within the top surface groove 15. A panel first end wall 21 having a first end wall groove 22 for reception of a panel second end wall 23 of an adjacent panel member 16, and the panel second end wall 23 is formed with a panel second end wall flange 24 to provide for locking registration of the panel members together as indicated and reception of the panel members, and more particularly, the panel member bottom wall engaging flanges 20 within the top surface groove 15.

Figure 5:
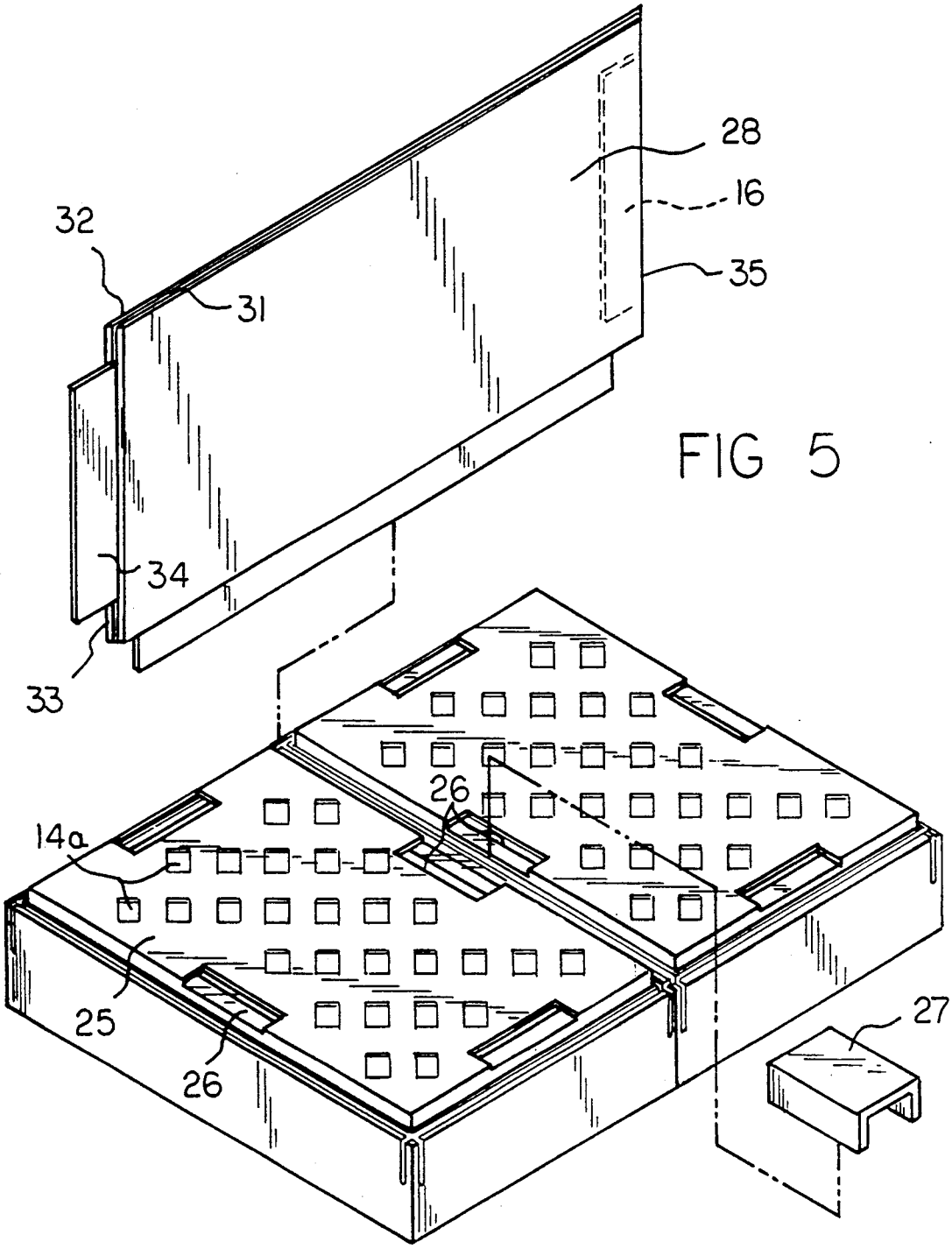
FIG. 5 is an isometric illustration of a plurality of bases including modified top walls permitting securement of the bases together.

The FIG. 5 indicates the use of a modified top wall 25, having registration openings 26 positioned medially of each side of the base top wall 25 in adjacency to the side wall top surface 13. In this manner, abutting adjacency of a plurality of the base members provides for a face-to-face relationship of a plurality of said registration openings 26 to receive a U-shaped latch member 27 within such plurality of facing registration openings 26 to secure the base members together. Further, and to this end, an additional spanning enclosure plate 28 may be provided, having an enclosure plate bottom wall 29, with a spanning plate flange 30 received within the top surface groove 15, as described above, with the spanning plate top wall 32 having a top wall groove 31. A spanning plate first end wall 33 is formed with a spanning plate first end wall flange 34 for reception with one of the enclosure panel members 16, with a spanning plate second end wall 35 having a second end wall groove 36 to receive a second end wall flange 24 of an associated enclosure panel member 16. It should be noted that the flange 34, as indicated in phantom in FIG. 5, may be aligned longitudinally on a coplanar relationship with the plate 28 and to this end, the flange 34 accommodates displays of a series of pallet members to permit their interconnection. In this manner, displays of dimensions to accommodate any product to be enclosed may be thusly provided. Further it should be understood that the plates 28 may be of flexible construction to accommodate various geometric configurations such as circular, triangular, and the like.

The FIGS. 6 and 7 indicates the use of the top wall 14 having a top wall central opening 37 oriented medially of the top wall 14 or of the modified top wall 25 as may be employed. A floor plate 38 is positioned upon the top wall in a displaceable relationship coextensive with the top wall, wherein a side wall opening 39 directed through the side wall of the base 11 receives a jack assembly actuator handle 42 for cooperation with the jack assembly 40. The jack assembly 40 may be of a screw type or of a hydraulic type as is convenient for one of ordinary skill in the art to employ. The jack assembly 40 includes a jack assembly piston 41 fixedly and orthogonally mounted medially of the floor plate 38 to permit selective lifting of the floor plate relative to the platform base top wall. In this manner, a display may be raised or lowered relative to the base 11 for visual display as desired.

Figure 8:
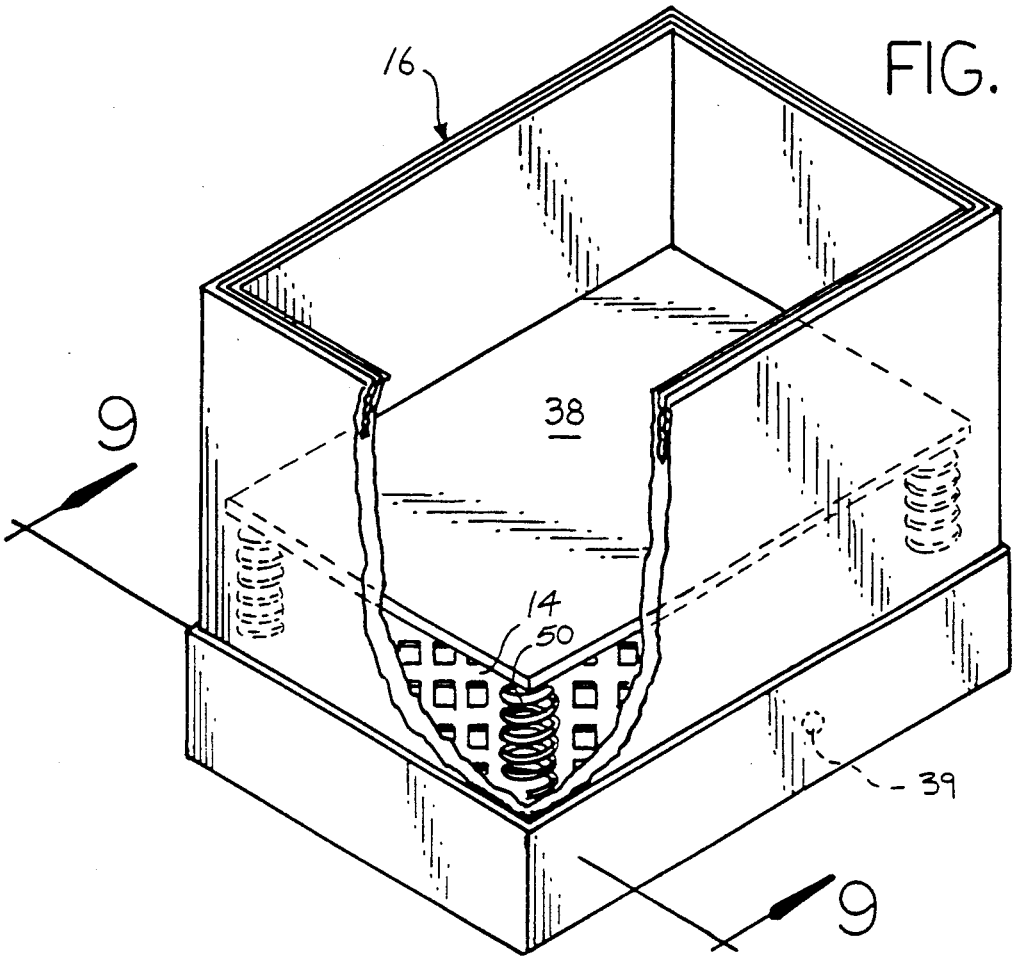
FIG. 8 is an isometric illustration of a further aspect of the invention, including variable rate spring member mounted intermediate the base top wall and the floor plate.
Figure 9:
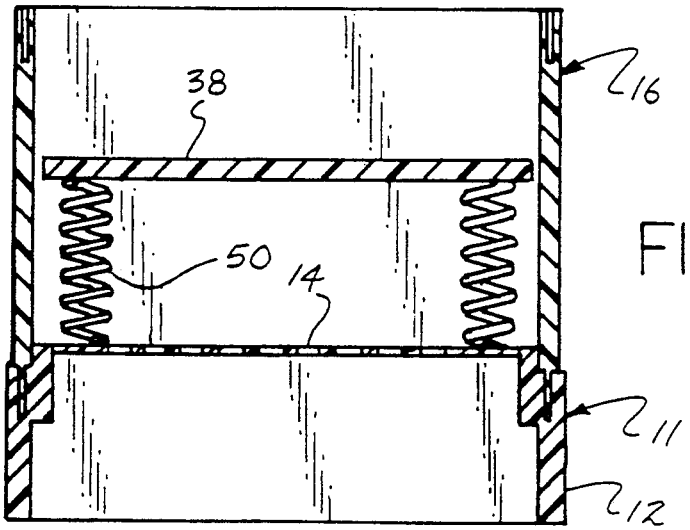
FIG. 9 is an orthographic view, taken along the lines 9—9 of FIG. 8 in the direction indicated by the arrows.

FIGS. 8 and 9 indicate the use of variable rate springs 50 mounted intermediate the top wall 14 and the floor plate 38 to effect automatic protection of products and components positioned upon the plate 38 to provide for automatic lifting of such products.

The object therefore of the invention is to accommodate and provide for display of tiered components and wherein various jacking members such as a jack structure, as indicated in the FIGS. 6 and 7, as well as the variable rate spring structure, as indicated in FIGS. 8 and 9, may be employed to enhance the display to effect raising of products of the display for their visual attraction to consumers. Further, it should be understood that the variable rate spring members 50 may be employed in concert with the jacked assembly of the FIGS. 6 and 7 and to this end, the aperture structure directed through the side wall 12 as indicated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pallet display apparatus, comprising, a platform base, the platform base having a continuous side wall, with the side wall including a side wall top surface, the platform base further having a base top wall spaced from the side wall top surface, with the base top wall including a top surface continuous groove directed therein, a plurality of enclosure panel members arranged for securement relative to one another and to the continuous groove, the enclosure panel members are each of an L-shaped configuration, having a panel top wall, the panel top wall including a top wall groove and a panel bottom wall, with the panel bottom wall having a bottom wall engaging flange for reception and securement within the continuous groove, and the panel members each including a first end wall having a first end wall groove, and a second end wall having a second end wall flange, wherein the first end wall groove of one of said panel members is arranged for reception within the second end wall flange of a further of said panel members, wherein the panel members are continuous about the base top wall, and are substantially orthogonally oriented relative to the base top wall projecting thereabove, a floor plate mounted upon the base top wall, wherein the floor plate is coextensive with the base top wall, and a jack assembly mounted within the base, with the jack assembly including a jack assembly piston, and the base top wall having a central opening directed medially of the base top wall, with the jack assembly piston arranged for reception through the central opening, and the continuous side wall having a side wall opening, and a jack handle directed through the side wall opening to permit actuation of the jack assembly exteriorly of the platform base, and the jack assembly piston mounted fixedly and orthogonally relative to the floor plate to permit selective lifting of the floor plate relative to the base top wall, and a further platform base, wherein the further platform base includes a further platform base top wall, wherein the base top wall and the further base top wall each include a facing registration opening, and a U-shaped latch member arranged for mounting within each said facing registration opening to secure the platform base and the further platform base together.

2. An apparatus as set forth in claim 1 wherein a plurality of spring members are interposed between the floor plate and the base top wall to effect automatic lifting of components positioned upon the floor plate.

* * * * *